US006398619B1

(12) United States Patent
Webb

(10) Patent No.: US 6,398,619 B1
(45) Date of Patent: Jun. 4, 2002

(54) PARTY STREAMER DISPENSER

(75) Inventor: Walter L. Webb, Mountain Home, NC (US)

(73) Assignee: Dean A. Craine, P.S., Bellevue, WA (US)

( * ) Notice: Subject to any disclaimer, the term of this patent is extended or adjusted under 35 U.S.C. 154(b) by 97 days.

(21) Appl. No.: 09/596,202

(22) Filed: Jun. 15, 2000

Related U.S. Application Data

(60) Provisional application No. 60/139,332, filed on Jun. 15, 1999.

(51) Int. Cl.[7] ..... A63H 37/00

(52) U.S. Cl. ..... 446/475; 242/588.6; 242/129; 156/579

(58) Field of Search ..... 446/475; 242/588, 242/588.2, 588.3, 588.6, 128, 129; 156/574, 579

(56) References Cited

U.S. PATENT DOCUMENTS 2,285,270 A * 6/1942 Gelow ..... 242/588
4,706,442 A * 11/1987 Riemenschneider ..... 242/588
5,725,726 A * 3/1998 Yu ..... 242/588.2
6,024,323 A * 2/2000 Palermo, Jr. ..... 242/588.6

* cited by examiner

*Primary Examiner*—Jacob K. Ackun
(74) *Attorney, Agent, or Firm*—Dean A. Craine

(57) ABSTRACT

A party streamer dispenser for decorating a room. The dispenser includes a body which holds a roll of crepe paper, a roll of adhesive tape, and an adjustable handle that selectively attaches to an elongated pole. The body comprises a cap and a frame that are disposed and compressed against opposite sides of the roll of crepe paper. A threaded bolt extends transversely between the cap and frame and through the center bore on the roll of crepe paper. Integrally formed on the frame is a laterally extending neck around which a roll of adhesive tape is placed. Extending laterally from the distal end of the neck is an extension. During assembly, an end cap is pivotally attached to the lateral extension. An elongated pole may be placed into the end cap so that the user may use the elongated pole to elevate the dispenser to a desired elevated location in the room. During use, the dispenser is held so that the crepe paper unravels transversely from the roll as the dispenser is held perpendicular to the direction of travel and moved across the room thereby simultaneously dispensing and twisting the crepe paper into a streamer.

11 Claims, 2 Drawing Sheets

PARTY STREAMER DISPENSER

This utility patent application is based on the provisional patent application (Ser. No. 60/139,332) filed on Jun. 15, 1999.

BACKGROUND OF THE INVENTION

1. Field of the Invention

The invention disclosed herein relates a party streamer dispenser and, more particularly, to dispensers for a roll of crepe paper.

2. Description of the Related Art

When decorating for a party, crepe paper is often hung from doorways, lamps and ceilings to create a festive atmosphere. The crepe paper is normally attached to doorways, lamps and ceilings with removable adhesive tape. Usually, the crepe paper is dispensed from large rolls into long, twisted streamers. Keeping the crepe paper on the roll, as it is being dispensed and twisted, is difficult. It is especially difficult to tear a piece of adhesive tape from a tape dispenser while holding the end of twisted crepe paper to a desired object.

SUMMARY OF THE INVENTION

It is an object of the present invention to provide a party streamer dispenser.

It is another object of the present invention to provide such a dispenser that dispenses the crepe paper in long, twisted streamers.

It is further object of the present invention to provide such a dispenser that also includes means for dispensing adhesive tape.

These and other inventions are met by a party streamer dispenser used to dispense streamer material, such as crepe paper, from a roll when decorating a room. The dispenser includes a fixed body which holds a large roll of crepe paper, a tape holding means attached to the body for holding adhesive tape, and a pole attachment means attached to the body that allows the body to be selectively attached to an elongated pole.

The body comprises a circular cap and a circular frame disposed in parallel alignment on opposite sides of a roll of the crepe paper. A transversely aligned bolt extends between the cap and frame and through the roll of crepe paper to hold the cap and frame against the opposite sides of the roll. Integrally formed on the side of the frame opposite the roll of crepe paper is a laterally extending neck which acts as a tape holding means. A roll of adhesive tape is placed around the neck and is able to freely rotate so that tape may be rotated and dispensed therefrom. Attached to the distal end of the neck is a pole attachment means, which enables the end of an elongated pole to be selectively attached to the body so that the user may elevate the dispenser to a desired height to dispense the crepe paper. An adjustment means is also provided between the neck and the pole attachment means to enable the body to be aligned at different angles relative to the longitudinal axis on the elongated pole.

Included on the side of the frame is an optional tape cutting means, which enables the adhesive tape or crepe paper to be easily cut with one hand.

During use, the roll of crepe paper is then held securely between the cap and frame. The body is held perpendicularly to the desired direction of the streamer so that the crepe paper is pulled transversely from the roll, thereby simultaneously dispensing and twisting the crepe paper into a streamer.

DESCRIPTION OF THE PREFERRED EMBODIMENT(S)

Figure 1:
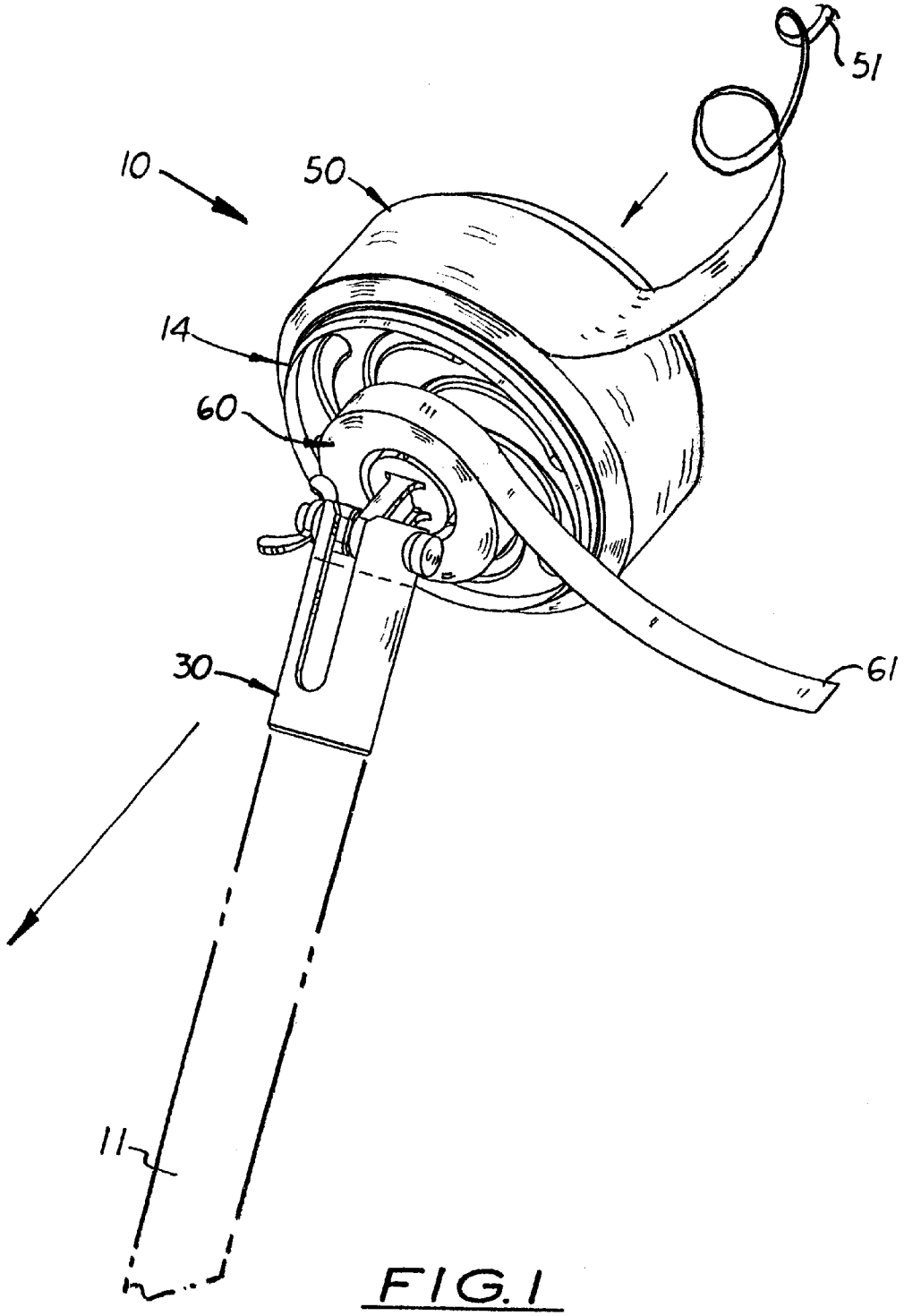
FIG. 1 is a perspective view of the party streamer dispenser disclosed herein.
Figure 2:
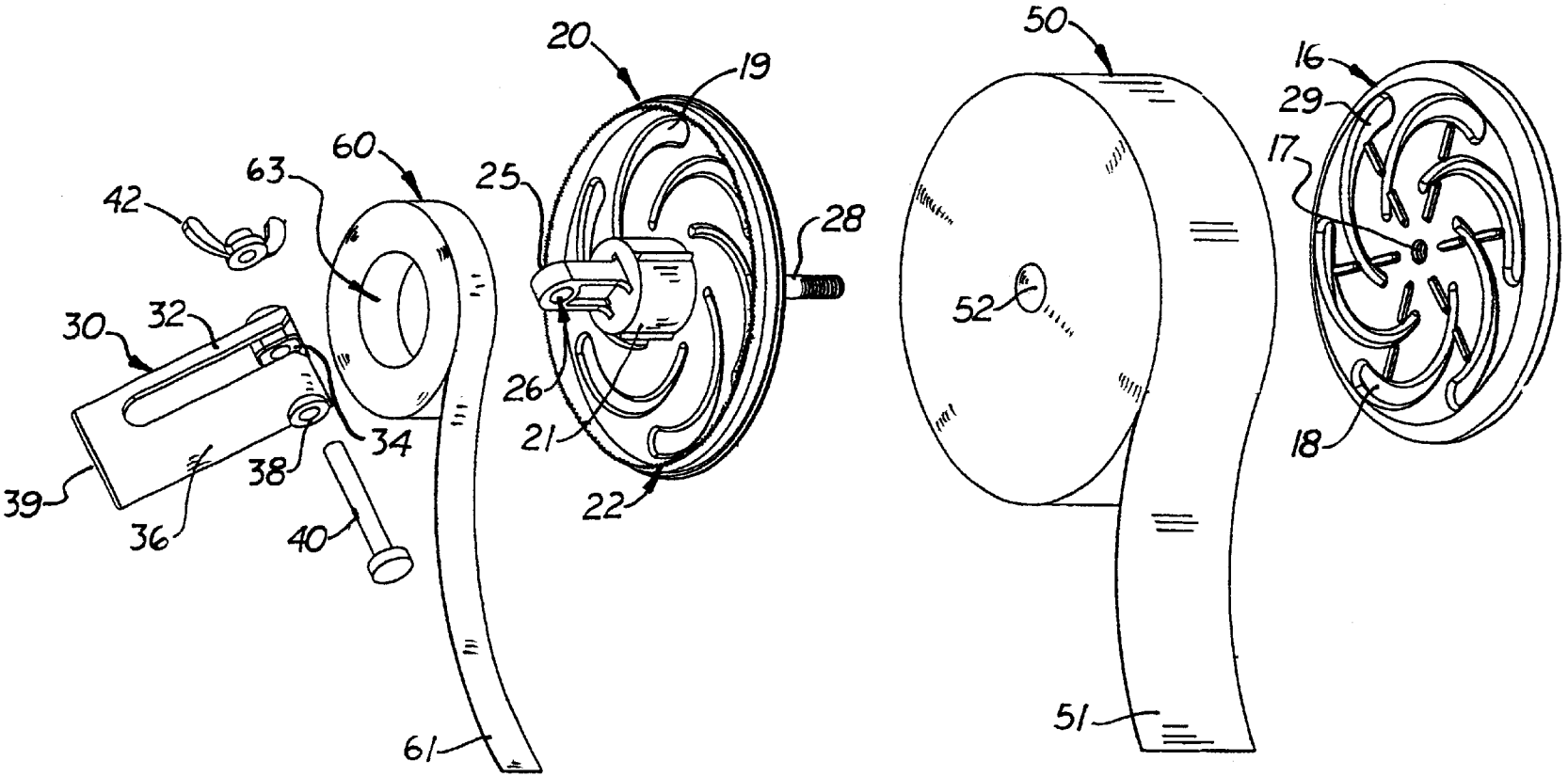
FIG. 2 is an exploded, perspective view of the party streamer dispenser.

As shown in the accompanying FIGS. 1–2, there is shown and described a party streamer dispenser 10 used to simultaneously dispense and twist crepe paper 51 from a roll 50 when decorating a room. The dispenser 10 includes a body 14 which holds a large roll 50 of crepe paper 51, a tape holding means which holds a roll 60 of adhesive tape 61, and an a pole attachment means that selectively attaches the body 14 to an elongated pole 11.

The body 14 comprises a circular cap 16 and a circular frame 20 that are aligned in a parallel manner on opposite sides of a roll 50 of crepe paper 51. A transversely aligned threaded bolt 28 extends from the inside surface along the center axis of the frame 20 and connects to a transversely aligned threaded bore 17 formed on the inside surface of the cap 16. During use, the cap 16 is attached to the end of the bolt 28 and tightened until the inside surfaces of the cap 16 and frame 20 are pressed against the sides of the roll 50. Formed on the inside surface of the cap 16 and frame 20 are optional raised surfaces 19, 29, respectively.

Integrally formed on the outside surface of the frame 20, opposite the bolt 28, is a laterally extending centrally aligned, cylindrical neck 21. Longitudinally aligned and attached to the distal end of the neck 21 is a rigid extension 25. Formed near the distal end of the extension 25 is a transversely aligned hole 26 which receives a transversely aligned bolt 40 used to connect the extension to the end cap 30. The diameter of the neck 21 is sufficient to extend into the bore 63 of the spool used on a standard roll 60 of adhesive tape 61.

The pole attachment means comprises the hole 26, a cylindrical-shaped end cap 30 with a central passageway 39 designed to receive the end of an elongated pole 11, the bolt 40, and a wing nut 42. The end cap 30 includes two opposite, longitudinally aligned side members 32 and 36 which are forced together via the bolt 40 and wing nut 42. The bolt 40 is inserted through bores 34, 38 located on the distal ends of two side members 32 and 36, respectively. A wing nut 42 connects to the threaded end of the bolt 40. During assembly, the extension 25 on the neck 21 is inserted into the space created between the two side members 32, 36 so that the bore 26 is aligned with the bores 34 and 38 thereby enabling the bolt 40 to extend through and pivotally connect the body 14 to the end cap 30.

Included on the side of the frame 20 is an optional tape cutting means, which enables a user to easily cut a piece of adhesive tape 61 from the roll 60 with one hand. In the embodiment shown, the tape cutting means is a continuous ring 22 placed near the outside, outside edge of the frame 20. The ring 22 has a cutting teeth 23 formed thereon capable of cutting the adhesive tape 61 when forced against it.

In the preferred embodiment, the body 14 is designed to hold a standard 5–½-inch diameter roll 50 of crepe paper 51, approximately two (2) inches in width. The neck 21 has sufficient length and diameter to hold a standard two-inch diameter roll 60 of adhesive tape 61, ½ to one inches in width. Standard rolls 60 of adhesive tape 61 use spools with one-inch diameter bores. In the preferred embodiment, the neck 21 is slightly smaller than the bore 26 (approximately 15/16 inch in diameter), thereby enabling the spool to freely rotate over the neck 21. The cap 16 and frame 20 are approximately five (5) inches in diameter and made of lightweight material, such as plastic or fiberglass. The passageway 39 formed in the end cap 30 is approximately one and one-sixteenth (1 1/16) inches in diameter and designed to receive the end of a one-inch-diameter elongated pole 11.

During use, a desired roll 50 of color crepe paper 51 is selected and attached to the body 14. The body is then attached to a pole 11. The end of the crepe paper 51 is then adhesively attached to a desired surface using a piece of adhesive tape 61 removed from the roll 60. The dispenser 10 is then held so that the crepe paper 51 unravels laterally from the body 14 to form a twisted streamer. The dispenser 10 is then moved to the desired direction where the opposite end of the crepe paper 51 is attached. The adhesive tape 61 is then grasped and extended a desired length across the ring 22. The crepe paper 51 is then torn and attached to the desired location using the piece of adhesive tape 61.

In compliance with the statute, the invention described herein has been described in language more or less specific as to structural features. It should be understood, however, that the invention is not limited to the specific features shown, since the means and construction shown, comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A party streamer dispenser, comprising:

a. a body including a frame and a cap connected together and spaced apart on opposite sides of a roll of crepe paper;

b. a tape holding means attached to said body capable of holding a roll of adhesive tape;

c. a pole attachment means attached to said body enabling said body to be selectively attached to a pole;

d. a roll of crepe paper disposed between said frame and said cap; and e. a roll of tape attached to said tape holding means.

2. The party streamer dispenser, as recited in claim 1 wherein said tape holding means is a laterally extending neck capable of receiving said roll of tape.

3. The party streamer dispenser, as recited in claim 2, wherein said pole attachment means is an extension attached to said neck and an end cap attached to the end of an elongated pole, said end cap being pivotally connected to said extension.

4. The party streamer dispenser, as recited in claim 1, further including a tape cutting means attached to said body.

5. The party streamer dispenser, as recited in claim 4, wherein said tape cutting means is a circular ring with an outer cutting edge attached to said body.

6. A party streamer dispenser, comprising:

a. a body including a frame and a cap connected together and spaced apart on opposite sides of a roll of crepe paper;

b. a roll of crepe paper disposed between said frame and said cap;

c. a neck attached to said frame;

d. a roll of tape attached to said tape holding means;

e. an extension attached to said neck;

f. a pole attachment means; and, g. a pivoting means disposed between said extension and said pole attachment means.

7. The party streamer dispenser, as recited in claim 6, further including a tape cutting means attached to said body.

8. The party streamer dispenser, as recited in claim 7, wherein said tape cutting means is a circular ring with an attached cutting edge attached to said body.

9. The party streamer dispenser, as recited in claim 6, wherein said pole attachment means is an end cap that attaches to the end of an elongated pole.

10. The party streamer dispenser, as recited in claim 9, wherein said pivoting means is a bolt and a pair of holes on said end cap and at least one hole on said extension.

11. A party streamer dispenser, comprising:

a. a body including a frame and a cap connected together and spaced apart on opposite sides of a roll of crepe paper;

b. a roll of crepe paper disposed between said frame and said cap;

c. a neck attached to said frame;

d. a roll of tape attached to said tape holding means;

e. an extension attached to said neck;

f. a pole attachment means;

g. a pivoting means disposed between said extension and said pole attachment means; and, h. a tape cutting means attached to said body.

* * * * *